United States Patent [19]

Kruyer

[11] 4,224,138

[45] Sep. 23, 1980

[54] PROCESS FOR RECOVERING BITUMEN FROM OIL SAND

[76] Inventor: Jan Kruyer, 9707-67 A St., Edmonton, Alberta, Canada, T6B 1S3

[21] Appl. No.: 37,896

[22] Filed: May 10, 1979

[51] Int. Cl.[2] ..... C10G 1/00

[52] U.S. Cl. ..... 208/11 LE

[58] Field of Search ..... 208/11 LE

[56] References Cited

FOREIGN PATENT DOCUMENTS

| | | | |
|---|---|---|---|
| 657877 | 2/1963 | Canada | 208/11 LE |
| 741302 | 8/1966 | Canada | 208/11 LE |
| 778347 | 2/1968 | Canada | 208/11 LE |
| 787898 | 6/1968 | Canada | 208/11 LE |
| 975700 | 10/1975 | Canada | 208/11 LE |
| 996485 | 9/1976 | Canada | 208/11 LE |

*Primary Examiner*—Delbert E. Gantz
*Assistant Examiner*—Joseph A. Boska
*Attorney, Agent, or Firm*—Criddle & Western

[57] ABSTRACT

Bituminous sand such as oil sand or tar sand is mixed with steam and water in a tumbler to produce a slurry. Oversized particles are removed and the slurry is transferred into a water bath containing a submerged moving, apertured, separator, such as an endless belt having an oleophilic surface and top and bottom flights. The slurry falls through the water onto the top flight of the belt where the bitumen is attracted to the apertured oleophilic surface and adheres thereto. The adhering bitumen is then removed from the belt. Mineral particles in the slurry and the remaining bitumen pass through the apertures of the top flight and fall through the water onto the bottom flight of the belt. The remaining bitumen of the slurry is attracted to the apertured oleophilic surface of the bottom flight and adheres thereto. The adhering bitumen is then removed from the belt. The mineral particles of the slurry and a very small amount of remaining bitumen pass through the apertures to fall to the bottom of the water bath for subsequent removal.

The process gives a good recovery of bitumen product which has acceptable quantities of solid and water contamination. Compared with the prior art it has the feature that the oleophilic apertured surface does not have to be removed from the water bath to collect bitumen therefrom.

42 Claims, 12 Drawing Figures

PROCESS FOR RECOVERING BITUMEN FROM OIL SAND

BACKGROUND OF THE INVENTION

This invention relates to a process for extracting bitumen from oil sand. Oil sand is found in many parts of the world, in particular in Canada, the U.S.A., Venezuela, the U.S.S.R. and Malagasy.

Bitumen is presently commercially extracted in Canada from mined oil sand using a Hot Water Process. In accordance with this process, the oil sand is first mixed with water, caustic soda and steam in a rotating horizontal tumbler, called a conditioning drum. In this operation the components of the oil sand (i.e. bitumen, water and solids) are dispersed by a combination of heating and dilution with water. More particularly, the oil sand comprises grains having oil trapped therebetween. As water is added the sand grains collect therein; the bitumen separates from the grains and forms discrete flecks.

The slurry formed in the conditioning drum is then diluted with additional water and introduced into a separation vessel. This vessel has a cylindrical body and a conical bottom. Here the coarse sand grains drop the bottom of the vessel and are removed through an outlet as a tailings stream. This stream is discarded into a pond system. The bitumen flecks, which are slightly less dense than water because of the high process temperature, attach themselves to gas bubbles entrained in the slurry, rise through the vessel contents and form a froth product. This product over-flows the vessel wall into a launder and is collected. The fine solids remain largely suspended in the water of the separation vessel.

There are several problems of interest in the existing process. Firstly, there are difficulties connected with the bitumen flotation operation going on in the separation vessel. More particularly, if a large concentration of solids is present in the contents of the separation vessel, these solids will impede the upward progress of the aerated bitumen. Therefore, in order for the aerated bitumen to rise quickly through the vessel contents, it is desirable to have a dilute system within the vessel. This means that a relatively large amount of water must therefore be used in the process. Since this water must be heated to about 190° F., the energy requirement of the process are therefore increased as the water content is increased. Because large amounts of water are introduced into the process, it is necessary to withdraw a middlings dragstream from the midpoint of the vessel to maintain a balance. This middlings dragstream is treated in a subaerated flotation cell to recover contained bitumen, and is then discarded into the pond system. Unfortunately, fine solids (−325 Mesh), particularly clay, associated with the oil sand, pass through the process and end up suspended in the tailings water of the pond system. The presence of caustic soda in the tailings water influences these clay particles so that they settle extremely slowly and therefore the water must be held for a prolonged period in the pond before it is low enough in solids to be reused in the process. This then requires that inordinarily large tailings ponds be provided. In summary, the flotation mechanism in the prior art requires that large amounts of heated water be used and that solids removal in the ponds be extensive, thereby necessitating an extensive pond system.

In U.S. patent application Ser. No. 913,593 filed June 8, 1978 and now abandonded a process is claimed wherein an aqueous slurry of oil sand is brought into contact with an immersed, apertured, oleophilic surface in a water bath. The oil from the sand adheres to the immersed, oleophilic surface and the sand particles pass through the apertures. The oleophilic surface is then moved out of the water and the oil is removed from the oleophilic surface out of the water bath. While this process efficiently separates oil from an oil sand it requires both below and above water operations and considerably limits the size of the separation equipment which can be used and recovery of the oil from the oleophilic surface.

BRIEF DESCRIPTION OF THE INVENTION

With this background in mind, the present invention seeks to separate bitumen from oil sand or tar sand using a process which gets away from the flotation mechanism and the large amounts of water required by the Hot Water Process of the prior art, which can tolerate relatively higher levels of solid in the plant water and which can be carried out completely below the water surface.

In accordance with the broadest concept of the invention, a slurry of water, particulate solids, and oil, of a controlled consistency and temperature, is temporarily contacted by a sieve-like member having an oleophilic surface immersed in a water bath. Solids and water of the slurry pass through the apertures of the sieve-like member, while oil phase moves to its oleophilic surface and adheres thereto. The adhering oil phase is removed from the sieve-like member while it is immersed in the water bath. In a preferred embodiment, oil sand is first conditioned in a rotating tumbler with water and steam to produce a slurry by the combined action of tumbling and heating in the presence of water and steam. Oversize particles such as rocks, lumps of clay, debris and undigested oil sand are removed and the slurry is then transferred to an apertured separator such as a conveyor belt running approximately horizontally and contained in a water bath and below the water surface. Here some of the bitumen and most of the sand and other mineral particles of the slurry drop through the apertures while some of the bitumen is attracted to and adheres to the oleophilic surface of the belt. The adhering bitumen is then collected from the belt surface. The separator, when in the form of an endless conveyor belt, can be made to recover bitumen from the slurry in two sequential stages because it has two flights and both sides of the belt have oleophilic surfaces. Bitumen adheres to both those flights as the slurry is made to pass through the apertures of the top flight first and through the apertures of the bottom flight second. It has been found that good bitumen recovery can be achieved in this manner, even with a relatively high rate of slurry feed. The tailings product is low in bitumen and the bitumen product is low in solids and water content. The process is capable of tolerating a higher solids content in the plant water than used in the Hot Water Process of the prior art.

DETAILED DESCRIPTION OF THE INVENTION

In the first step of the preferred process, oil sand, water and steam are introduced into a conditioning drum 10 in amounts such that a slurry is produced containing enough water to give it a fluid consistency sufficient so that it will mix inside the conditioning drum at the desired temperature of conditioning. Due to the variability of oil sand feed stocks found in various locations, the actual amount of water required to achieve this may vary somewhat. Generally ranges of from 0.1 to 1.0 pounds of water per pound of oil sand are acceptable. The desired temperature in the conditioning drum varies somewhat also and is dictated to a degree by concerns of economics. Temperatures generally range from about 85° F. to 212° F. For example, within these parameters, at 180° F. the oil sand will break up into a slurry much faster than at 110° F. But the resulting slurry may need to be cooled prior to separation. The thermal energy cost for the process will be greater when the slurry is produced in the drum at this higher temperature and this will need to be balanced against the extra cost of a larger drum, needed when slurry is conditioned at the lower temperature, in order to provide the same rate of slurry production in each case. A slurry with a 25 percent water content by weight, produced at 140° F. is an acceptable compromise for many of the feedstocks. What is important is that sufficient water be present to allow all slurry components to be mixed at the conditioning temperature.

All percentages expressed hereafter are in weight percentage points.

Figure 2:
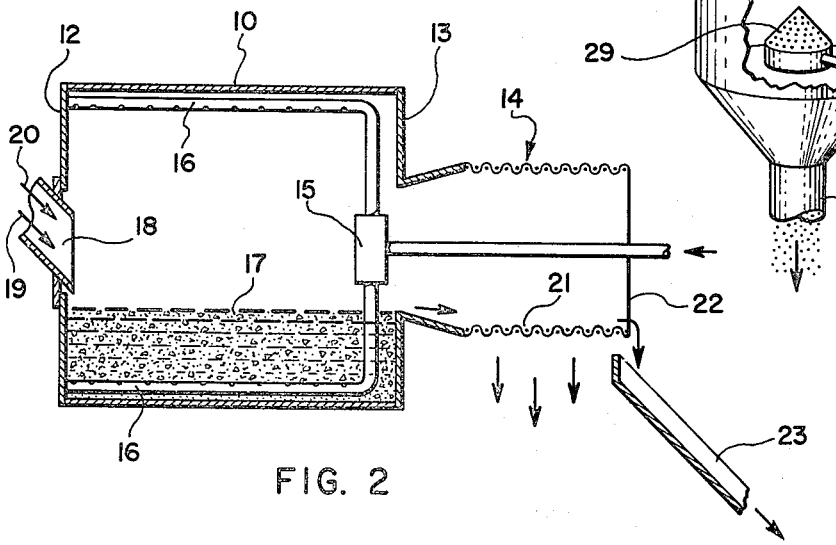
FIG. 2 is a cross sectional view of the tumbler of FIG. 1 taken along lines 2—2 of FIG. 1.

With reference to FIG. 2, the drum 10 is a horizontal, rotating cylinder having rear and front ends each partly enclosed by a washer 12 and 13. A cylindrical apertured screen 14 is mounted on the front washer 13.

Steam is introduced into the drum 10 through a distributor valve 15, which feeds it to a series of perforated pipes 16. These pipes 16 extend longitudinally along the interior surface of the drum in spaced relationship about its circumference. The valve 15 feeds the steam to the pipes 16 when they are submerged within the slurry 17. The oil sand 19 is fed into the rear end of the drum 10 by way of a channel 18. Water 20 is added to the oil sand at the rear end of the drum, also through channel 18. The ingredients mix in the drum and form a smooth slurry 17. This slurry spills over the front washer 13 into the cylindrical apertured screen 14. This slurry then drops through the apertures to the sieve type separator. In another embodiment of the invention the slurry drops into the inlet channel 28 of the sand reduction apparatus of FIG. 3, prior to going to the sieve type separator. Rocks and other oversize material leave through the front end 22 of the screen 14 and drop into chute 23 which conveys them to a discard area.

Figure 1:
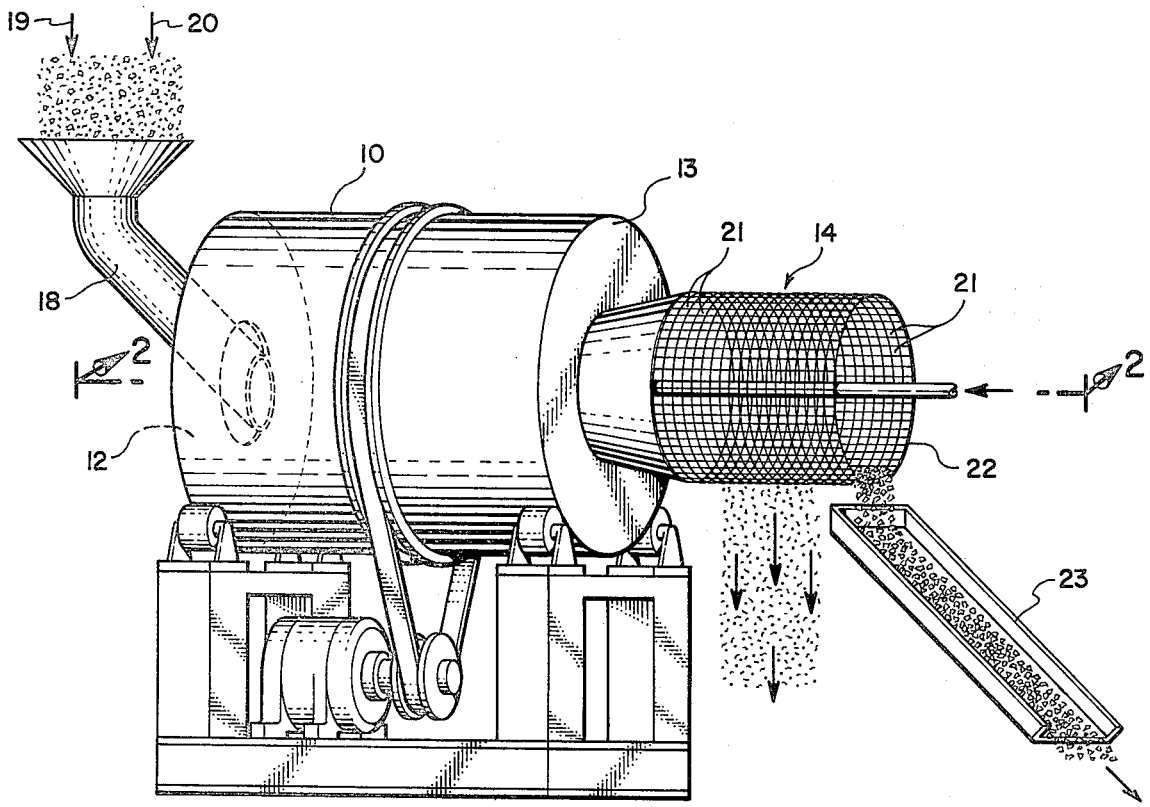
FIG. 1 is a perspective view showing the tumbler used in the preferred form of the invention to produce a slurry.
Figure 3:
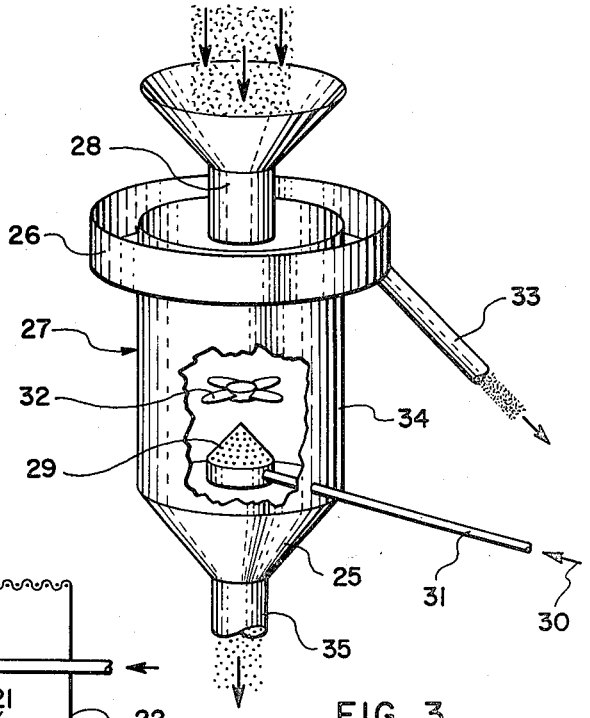
FIG. 3 is a perspective view of an apparatus for removing coarse solids from a slurry to the oleophilic sieve separator.

FIGS. 1-3 will now be referred to in greater detail. In the drum 10, the oil sand is jetted with steam, heated and formed into a slurry in which the water is in intimate contact with each sand grain and the bitumen agglomerates into globules or streamers.

The slurry that drops through the apertures 21 of the screen 14 connected to the drum 10 is transferred directly to a separator in the preferred embodiment of the invention to recover the bitumen. In this case the apertures 21 of the screen 14 are slightly smaller in size than the apertures of the sieve of the separator, and the screen has to be relatively large in size to allow a high throughput of slurry.

In another embodiment of the invention the sand content of the slurry is reduced and the slurry is diluted with water prior to any bitumen recovery. In this case the apertures 21 of the screen 14 can be larger. The sand reduction apparatus is illustrated in FIG. 3. It consists of a vessel 27 that has a cylindrical body 34 and a conical bottom 25 with an annular collar 26 at the top. This vessel is full of water (not shown) that continuously overflows and spills into the collar 26. Slurry from the screen 14 of the conditioning drum 10 enters the vessel 27 through an inlet channel 28 at a location some distance below the water level. A stirrer 32 or some other device creates a turbulence in the water and disperses the slurry. Water 30 flows through a pipe 31, through a distributor 29, into the vessel 27, in quantity sufficient, such that, the upward flow through the cylindrical body 34 is high enough to cause nearly all of the bitumen droplets, streamers and flecks to move upward in the vessel 27. This bitumen spills over the rim of the cylindrical body into the annular collar 26, along with water and fine mineral particles in the form of a slurry. This slurry is transferred to a belt separator through pipe 33 for subsequent recovery of bitumen. Compared with the slurry entering the vessel 27 through the channel 28, the slurry that is leaving the collar 36 through the pipe 33 can be controlled to be at a temperature optimum for the subsequent separation, it is more dilute and the solids have a smaller mean particle size. The pebbles, lumps and coarse sand, removed from the slurry in this manner, are discarded from the conical bottom 25 through a pipe 35 by means of a mechanical device such as a slurry pump.

In the sand reduction apparatus the coarse solids and oversize material are removed from the slurry and the slurry temperature is adjusted. This is done so that the rate of subsequent slurry separation by the oleophilic sieve separation apparatus can be increased. The sand reduction apparatus here described serves as an example only and is not intended to limit the invention in any way. Other means of sand reduction, removal of oversize material, or cooling of the slurry will be apparent to those skilled in the art.

Figure 4:
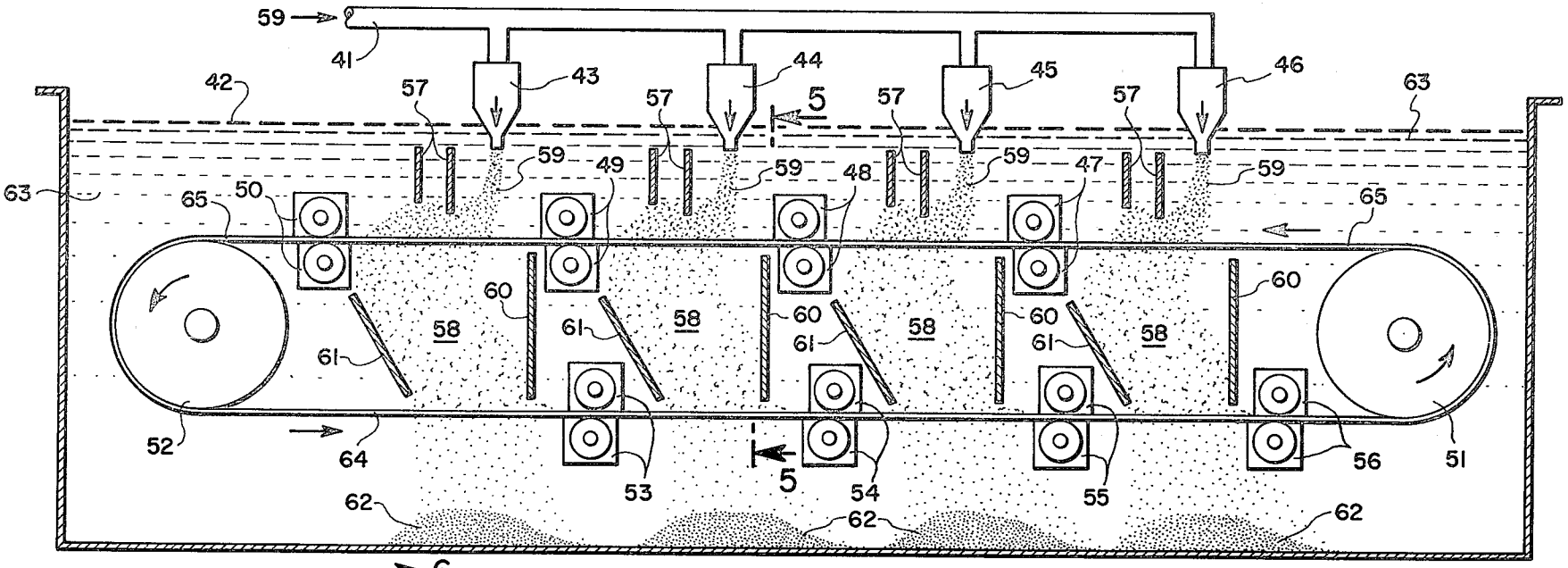
FIG. 4 is a schematic illustration of the overall process for separating bitumen from a slurry using an apertured oleophilic endless belt.

In the preferred separation step of the process the slurry produced from oil sand in the conditioning apparatus of FIG. 1, is transferred to a submerged belt separator. With reference to FIG. 4, this separator consists of an endless apertured conveyor belt having a top flight 65 and a bottom flight 64, stretched between two conveyor end rolls 51, 52, in a water bath 63 having a water level 42. These end rolls may be crowned to keep the belt running centrally on the end rolls. Both sides of this belt and the walls of the apertures are oleophilic. Slurry from the conditioning drum of FIG. 1 is conveyed through conduit 41 into hoppers 43, 44, 45 and 46, the bottom portions of which can be, but do not have to be, submerged below the surface of water 42, for the purpose of evenly distributing it at a multiplicity of locations along the belt. Bitumen recovery stations are mounted along the belt on both flights at a multiplicity of locations 47, 48, 49, 50, 53, 54, 55, and 56.

Since separation of the bitumen from the oil sand and recovery of the bitumen from the separator takes place simultaneously at a plurality of locations on both flights of the belt it is essential that both separation and recovery operations be capable of functioning under water. Multiple feed hoppers and recovery stations are not possible with the invention disclosed in Ser. No. 913,593 filed June 8, 1978.

Figure 6:
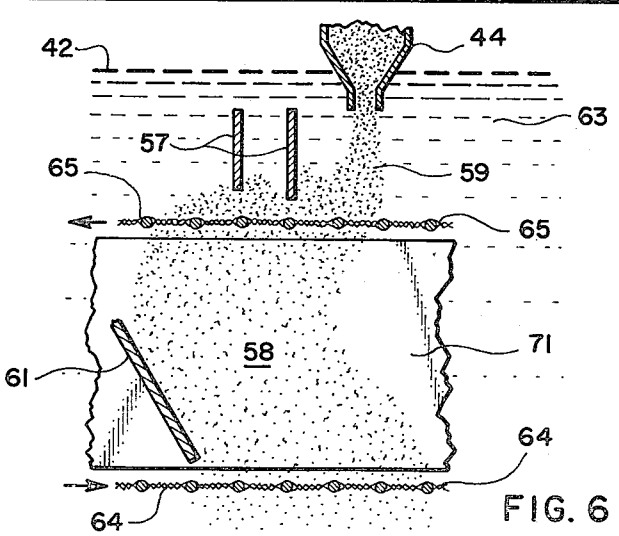
FIG. 6 is a partial, enlarged sectional view taken along lines 6—6 of FIG. 5.
Figure 5:
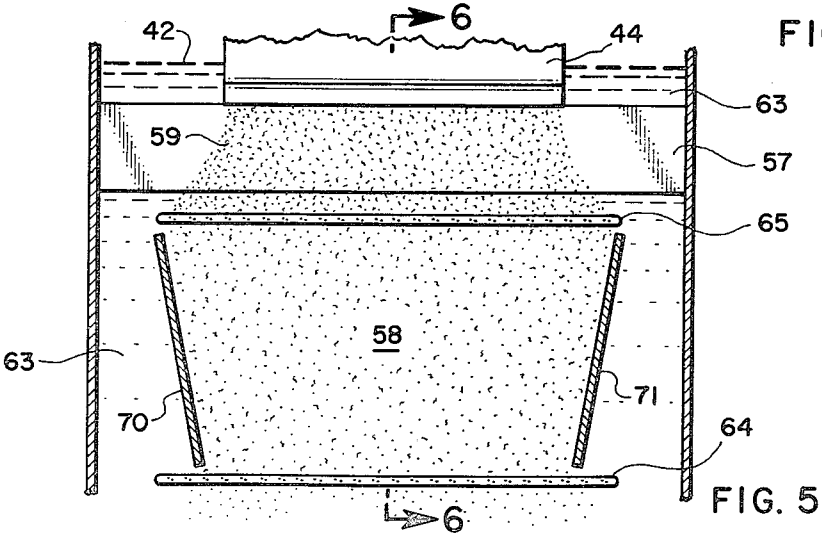
FIG. 5 is a partial enlarged transverse sectional view across the apertured conveyor belt, taken along lines 5—5 of FIG. 4 showing part of the slurry hopper, the top belt flight, slurry guide baffles and the bottom belt flight.

The separation and bitumen recovery at the various locations along the belt is similar. For that reason it is described here for bitumen hopper 44 and bitumen recovery stations 49 and 54, which together form one separation location. For the description reference is made to FIGS. 4, 5 and 6. The slurry 59 leaves hopper 44, in the form of a ribbon that is almost as wide as the belt and with a thickness and a velocity representing a slurry flow rate that can be conveniently separated by the belt. It falls through the water 42 and is diluted by it until it encounters the top belt flight 65 where water and the solids in the water phase pass through the apertures of the belt while the bitumen is attracted to the oleophilic surface of the belt. The top flight 65 of the belt which is in motion from the right to left in FIG. 4 carries this slurry along for some small distance before the separation is completed. Baffles 57 or other stirring means are provided to create turbulence in the water above the belt and to disturb any unseparated slurry resting on the belt surface.

The bitumen is recovered from the belt at location 49. The slurry 58 that has passed through the apertures of the top flight settles downward to the bottom belt flight. Baffles 60, 61, 70 and 71 serve to contain this slurry so that it will drop onto the bottom conveyor flight. As the slurry passes through the bottom flight 64 water and particulate solids 62 drop to the bottom of the water bath 63 from where they are removed. Substantially all of the bitumen that was not recovered at the top flight is attracted to the oleophilic surface of the bottom flight 64; which is in motion from left to right in FIG. 4. It is recovered at location 54. The solids 62 and the water are removed from the bottom of the water bath 63 at a rate such that a constant water level 42 is maintained in the bath. A pump, auger, or some other mechanical device (not shown) is used for this purpose.

While simultaneous separation by both top and bottom flights is here disclosed to show that a two stage separation process is readily achieved with the use of an endless belt, that should not be interpreted to imply that separation by one belt flight is not effective. The disclosure is for separating a slurry by means of an apertured oleophilic wall and one flight of the belt would represent such a wall; two belt flights would represent two such walls through which at least part of the slurry passes in succession and is separated thereby.

It has been found that when an oil sand slurry is dropped into a water bath the large sand grains, stripped of bitumen fall rapidly through the bath water and pass through the apertures of the belt to the bottom of the bath for subsequent removal. The smaller mineral particles and the bitumen or oil phase of the slurry fall much slower than the coarse sand grains and their rate of descent can be increased, for the purpose of increasing the separation rate, by withdrawing the excess water from the bath from below the belt instead of from above the belt. This rate of descent can be increased even further by continuously adding circulating water of the desired temperature to the top of the bath and withdrawing it continuously from the bottom of the bath. A descending bitumen or oil phase particle will normally contact and then adhere to an oleophilic surface of the apertured belt if the bitumen particle exceeds in size the width or breadth dimension of the aperture of the belt through which it attempts to pass. There is an increasing probability, for a given aperture size, with increasingly smaller bitumen particles, that bitumen particles will pass through belt apertures without coming in contact with an oleophilic surface of the belt. This probability can be reduced by passing the slurry through two oleophilic apertured surfaces in succession such as is done when both the top flight and the bottom flight of an endless belt are used for the separation.

The primary slurry, before dilution by water, need contain no more than three pounds of water per pound of solids. A slurry containing more water than that normally would not be prepared by a conditioning tumbler in the way described herein but slurries that contain more water than that can still be separated readily by the present invention if so desired. The slurry undergoing separation, however, should contain at least one half pound of water per pound of solids as it reaches the apertured wall. If the slurry is thicker, the bitumen is not easily separated from the solids by the apertured wall.

While these are not necessary for the separation, detergents, surfactants and/or wetting agents, as well as sodium hydroxide and other monoalkaline reagents have been added to the conditioning drum at times to improve removal of bitumen from the surfaces of the mineral particles prior to separating the slurry by the apertured wall. Careful control of the amount of reagent used has been found necessary, however, to prevent the formation of oil in water emulsions which are difficult to break and which have a tendency to pass through the apertures of the apertured wall; and also to prevent the production of bath water containing fine mineral particles that take inordinately long periods of time to settle.

Figure 7:
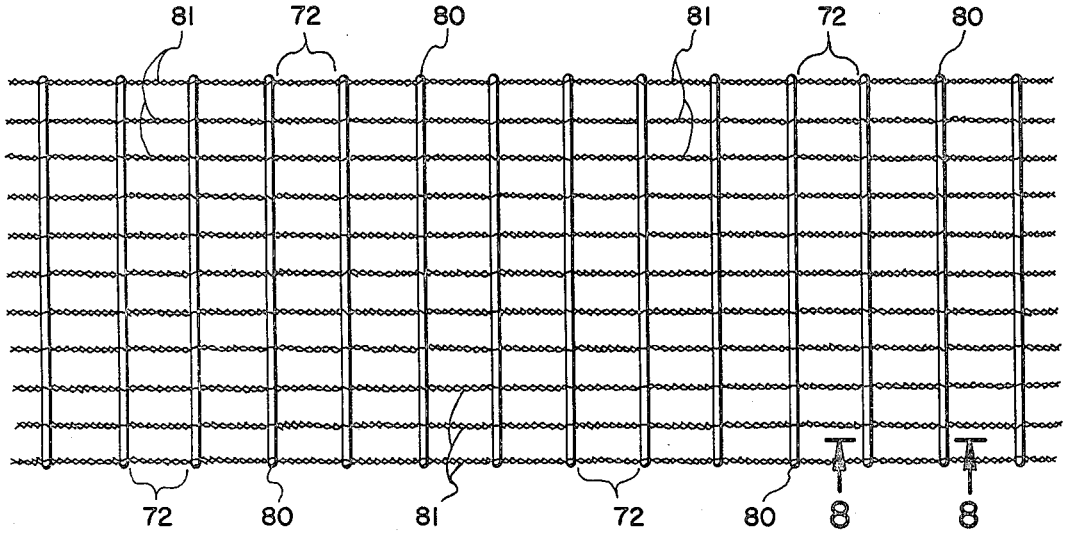
FIG. 7 is a top view of a section of an apertured oleophilic sieve belt in the form of a meshed construction.
Figure 8:
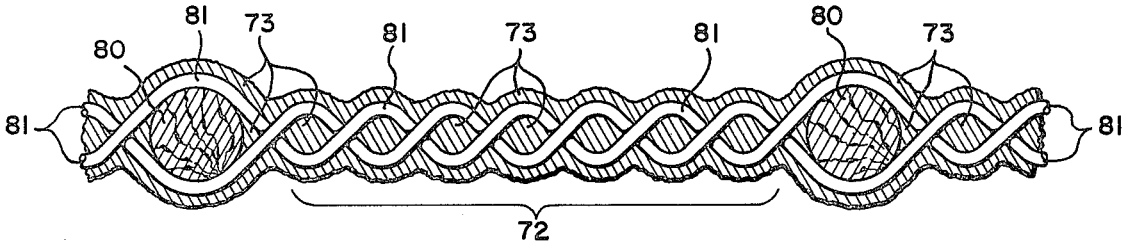
FIG. 8 is an illustration of the construction detail of the belt shown in FIG. 7 taken along lines 8—8 of FIG. 7.

An example of a section of apertured oleophilic belt is illustrated in FIG. 7. Construction details of this belt are shown in FIG. 8. The belt could consist of relatively more rigid members 80 across the belt that are woven into a mesh belt by the use of relatively more flexible members 81 along the belt. The flexible members 81 consist of cables constituting two or more strands which enclose each member 80 across the belt and which are twisted to maintain the desired spaced relationship between the members 80. This belt can be made from oleophilic materials and/or it can be covered by an oleophilic abrasion resistant coating 73. Depending upon their configuration, i.e. breadth, width or diameter, the size of the apertures 72 or the belt thus produced, preferably is within the range of 0.05 to 0.50 inches and most preferably within the range 0.1 to 0.3 inches. Solid particles of conventional oil sand slurries pass through the apertures 72 with increasing difficulty as the size of the apertures 72 diminishes below these minimum dimensions. There is a build up of slurry on the belt when this is the case. Conversely, the slurry begins to pass through the apertures 72 with increasing ease, without separating, as the apertures exceed these maximum dimensions; thereby reducing oil phase recovery. The size of the apertures is influenced to a large degree by the mean and the maximum particle size of the solids of the slurry 59, the concentration of solids in the slurry 59, the viscosity of the oil phase, the affinity of the oil phase for the oleophilic surface of the belt, the size of the oil phase particles, and the rate of slurry flow passing through the belt apertures 72. The size of the apertures along the belt, furthermore, is influenced by the velocity of the moving belt surface relative to the velocity of the slurry passing through the apertures. The surface speed of the belt will preferably be between 0.1 and 10.0 feet per second. For these reasons the physical characteristics of the slurry 59 to be separated will determine to a degree the actual size of the apertures 72 of the belt to be used and the surface speed of the belt. The mesh belt can be made from steel wires, stainless steel wires or from other thin rods or strands that are strong enough so that the belt can be used for extended periods in a commercial plant employing this process. A coating 73 of vulcanized neoprene or other oil resistant, oleophilic, abrasion resistant and strong material can be used to provide a bond between the members 80 across the belt and the members 81 along the belt. It is not intended that this invention be limited to the type of belt here described. Other kinds of mesh or perforated belt that can be used for this process will be apparent to those skilled in the art. Nylon mesh belts as is, or covered with an oleophilic coating, have been used successfully.

Effective temperatures for separating a slurry by the oleophilic sieve are those in which the oil phase recovered from the slurry has a viscosity in the range 0.1 to 10,000 poises with range of 3 to 3,000 poises being preferred and range of 10 to 1000 poises being most preferred. Most Alberta oil sand slurries can be separated at a temperature that is within the range of 85° F. to 140° F. although higher temperatures are not precluded. The rate of separation of Alberta oil sands begins to diminish and the collected bitumen contains increasingly higher percentages of mineral as the temperature decreases below 85° F. If the temperature exceeds 140° F. by about 20° F. i.e. 160° F., the bitumen begins to migrate in significant amount through the apertures and is lost with the water phase. Therefore, for separating Alberta oil sands the preferred range is 85° F. to 140° F. For separating Utah oil sands the preferred temperature range is 141° F. to 212° F. And for separating conventional crude oil from beach sand onto which it has washed because of an oil spill at sea, the preferred temperature may be as low as 32° F.

Figure 9:
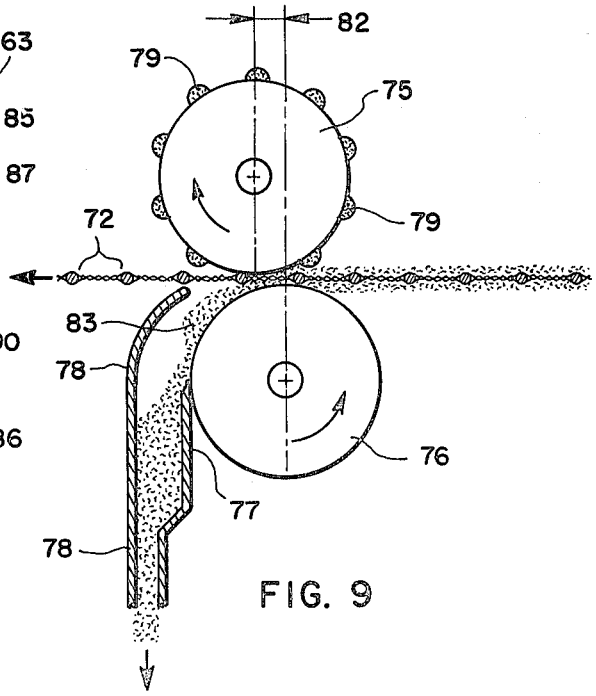
FIG. 9 is a schematic illustration of one method for recovering bitumen from an apertured oleophilic belt or disc using two rollers.

It is necessary to provide means for collecting the adhering bitumen from the belt surface and out of the belt apertures. With reference to FIG. 9, this may be done by forcing the bitumen through the apertures 72 with a transfer roller 75 and collecting it with a collector roller 76. The bitumen 83 on the collector roller 76 can be scraped therefrom with a doctor blade 77 for collecting in a hopper 78, from where it can be pumped or conveyed to a central gathering point for subsequent refining (not shown). The collector rollers normally are driven to provide motion to the belt. The transfer rollers are driven or are left to idle.

It has been found that the rollers can suitably be formed from a resilient, oil resistant material such as neoprene, urethane, etc. The collector roller 76 only works effectively if its surface is oleophilic but the transfer roller 75 may be either oleophilic or oleophobic. If the transfer roller 75 is oleophobic it will push the oil phase through the apertures 72 without leaving much residual bitumen on its own surface, but it will not do much to aid the recovery roller 76 in removing the bitumen out of the belt apertures 72. Open apertures are needed to allow subsequent slurry passage through the belt in the separation stage. When the belt is very thin, the recovery roller 76 is able to attract enough bitumen from the belt to open the apertures 72 by itself; a hydrophilic transfer roller 75 can then be used. In most commercial applications where the required belt strength necessitates a somewhat thicker belt, an oleophilic transfer roller 75 will be preferred. Such a roller pushes the bitumen through the apertures 72 onto the recovery roller 76, but subsequently, it withdraws some of the bitumen out of the apertures 72, keeping its surface covered with mounds 79 of bitumen and aiding the collector roller 76 in opening up the apertures 72. An oleophilic transfer roller 75 may be scraped with a doctor blade (not shown) to provide an additional stream of bitumen and increase somewhat the rate of bitumen recovery.

As shown in FIG. 9, a line perpendicular to the belt surface drawn through the center of the transfer roller 75 is offset some distance along the belt in the direction of belt movement from a line perpendicular to the belt surface drawn through the center of the recovery roller 76. As the belt moves, the transfer roller 75, offset by the proper distance, forces the bitumen collected on the belt surface through the apertures 72 and deposits it on the surface of the recovery roller 76. Progressively increasing this offset 82 from zero distance, initially increases the ease with which the bitumen is transferred until an optimum is reached; and then it starts to diminish and more and more of the bitumen remains on the belt. The optimum distance 82 is influenced by the belt construction and by the properties of the oil phase in the slurry. It is adjusted empirically for each application. Alternately, the offset distance can be set slightly in excess of optimum and then either the transfer roller or the recovery roller can be adjusted up or down. This will slightly inflect the belt and reduce the distance between the surface of the transfer roller and the surface of the recovery roller to achieve effective transfer of bitumen from the belt surface onto the surface of the recovery roller.

Figure 11:
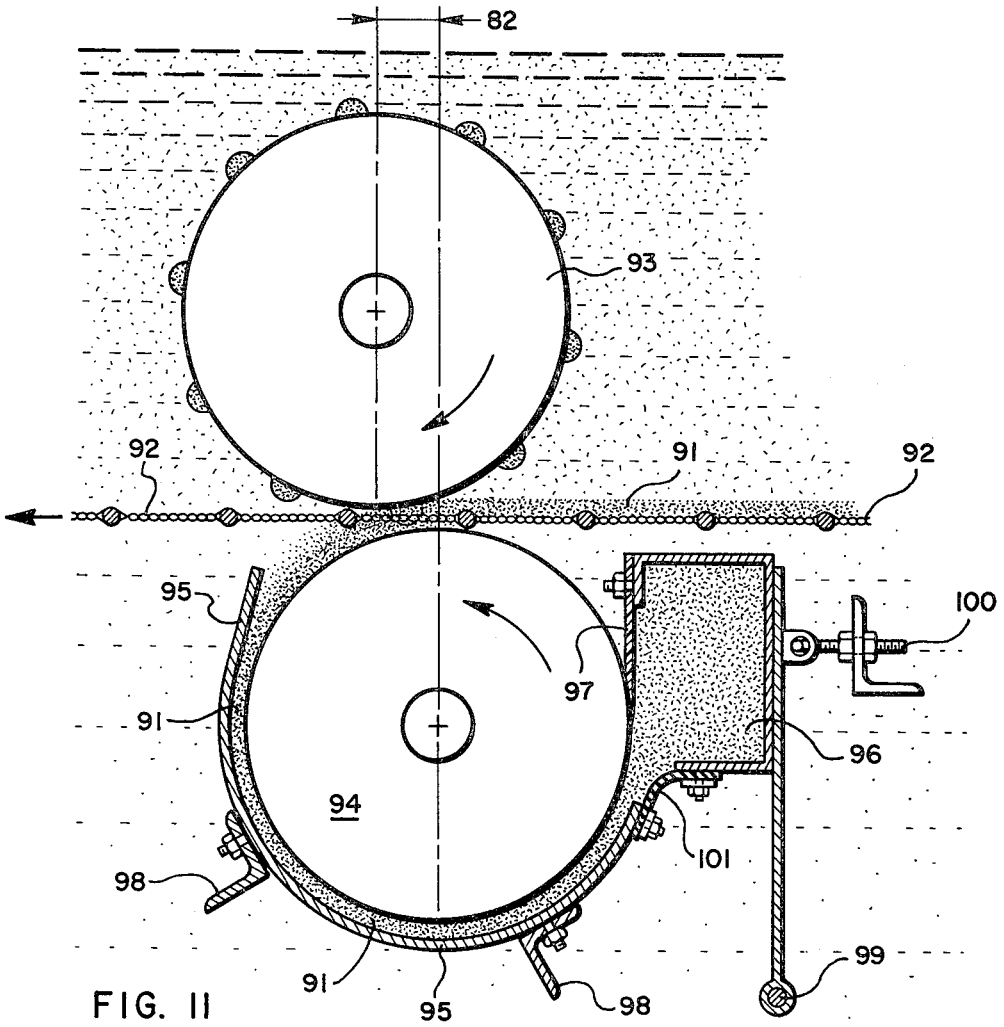
FIG. 11 is a schematic illustration of another method for recovering bitumen or oil from an apertured oleophilic belt of disc using two rollers with a cover provided on one of the rollers to contain the bitumen and cause it to flow under pressure.

Recovery of bitumen scraped from a roller by a doctor blade will be simplified under the water if it can be made to flow under the influence of pressure instead of under the influence of gravity. The force of gravity on bitumen immersed in water is very small and therefore bitumen will accumulate on the doctor blade unless it is reamoved by some other means such as suction or pressure or force. One such method is illustrated in FIG. 11. As shown, bitumen 91 covering the surface of an apertured oleophilic conveyor belt 92 is removed with the use of two rollers. The transfer roller 93 pushes the bitumen that is resting on top of the belt through the apertures of the belt onto the surface of the recovery roller 94 which is oleophilic. The belt and the recovery roller are fully immersed in water, and bitumen, scraped by a doctor blade from the surface of this roller, needs to be contained in order to be properly recovered. For that reason, a cover 95 is provided which forms a cavity between it and the surface of the recovery roller which contains the bitumen. At the entrance of the cavity the cover is flared out somewhat to encourage all the bitumen that is on the roller surface to enter the cavity. The cavity expands into a chamber 96 where the bitumen collects. A doctor blade 97 forms one of the walls of the chamber and removes most of the bitumen from the surface of the recovery roller, thereby reducing the amount of bitumen carried along by the roller surface leaving the chamber. Any other sudden reduction in distance between the chamber wall and the roller surface at the end of the chamber could have been used also to remove bitumen from the roller surface but a doctor blade does it more effectively. The movement of the roller surface carries the bitumen through the cavity into the chamber until the chamber and the cavity are full. After that the movement of the roller surface creates shear in the bitumen in the cavity and puts the bitumen in the chamber under pressure. This causes the bitumen to flow through the chamber 96 towards the end of the recovery roller from where it can be caught and pumped away by, for example, a diaphragm pump.

The cover is attached to supported brackets 98 whose supports are not shown. The doctor blade 97 is made adjustable. This can be done by, for example, supporting the chamber with a pivot 99 and an adjustment screw 100 or by some other means. In this case a flexible wall 101 will be required to keep the bitumen contained and still provide adjustment of the doctor blade.

Figure 12:
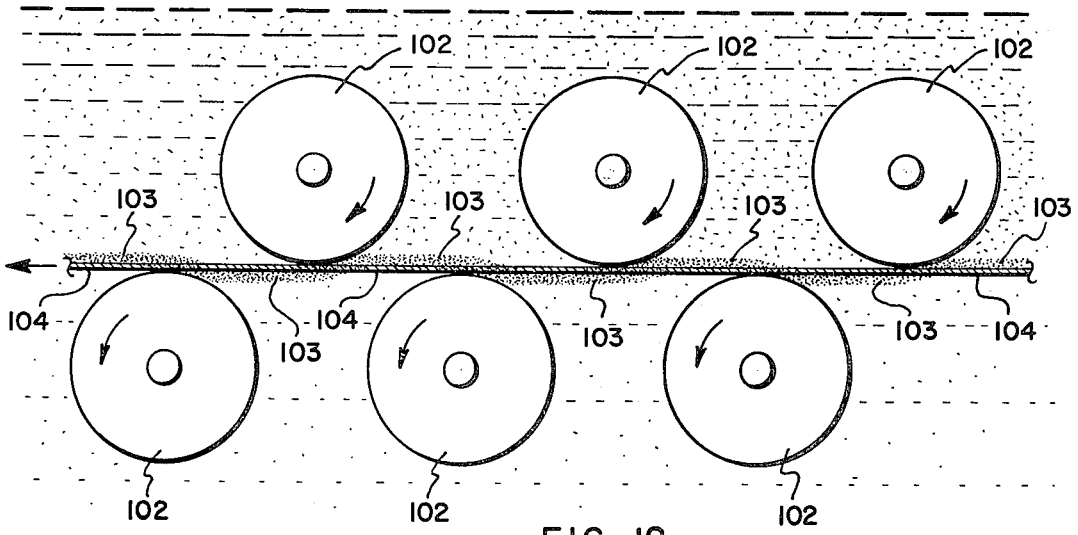
FIG. 12 is a schematic illustration of a series of transfer rollers in contact with an oleophilic belt surface, alternately above the belt flight and below the belt flight, to cause bitumen to be forced through the belt apertures back and forth prior to its recovery.

Forcing the bitumen through the belt apertures 72 immersed in the water bath, back and forth several times, helps to expulse and disperse some of the hydrophilic solids trapped by the bitumen. When that is done, the collected bitumen will have a lower solids content. The process will thus be more valuable if transfer rollers are used sequentially, which are in contact with the oleophilic belt surface, alternately above the belt flight and below the belt flight, to cause the bitumen to be forced through the belt apertures back and forth at least one or more times prior to its recovery. Oleophilic transfer rollers are preferred in this case in contrast with oleophobic transfer rollers because their attraction for bitumen will aid in exposing hydrophilic particles trapped by the bitumen. The oleophilic roller surface, acting in conjunction with the oleophilic belt surface actually tears the bitumen apart to expose the hydrophilic solids to the washing action of the water of the water bath. After that, the bitumen is extruded again through the apertures and then is torn apart again by the combined action of the belt surface on the opposite side of the belt, and the roller surface in contact with that opposite belt surface. The bitumen on the belt can be made to go through as many extrusion and tearing cycles as is desired, simply by adding the required number of transfer rollers opposite each other along the belt surfaces. A series of such transfer rollers 102 for extruding bitumen 103 back and forth through a belt 104 and exposing it to tearing and washing action are shown in FIG. 12.

Figure 10:
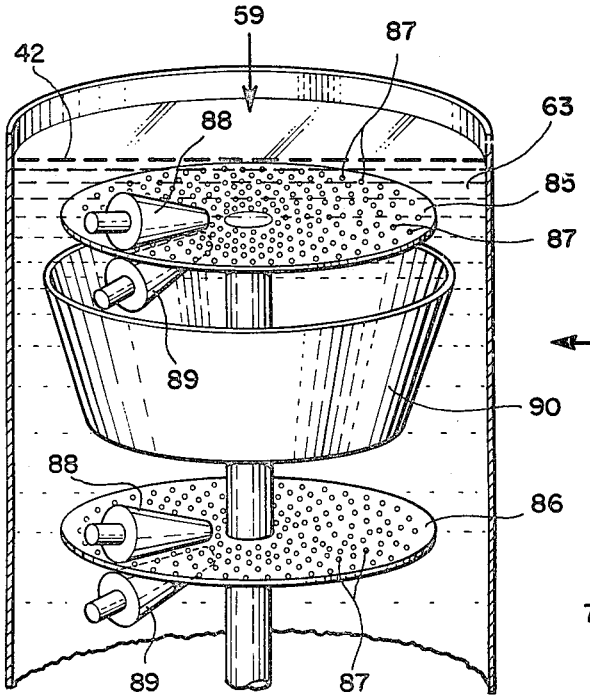
FIG. 10 is a perspective view of an alternate form of the invention, showing two apertured oleophilic discs mounted in such a way that the slurry passes through the top disc first and though the bottom disc second. A baffle guides the slurry from the top disc to the bottom disc. Bitumen is recovered from both discs by the conical rollers.

With reference to FIG. 10, oleophilic disc sieves can be used for the separation instead of oleophilic belt flight sieves. A two stage disc separator is shown, having a top disc 85 and a bottom disc 86, both with apertures 87 and both provided with a transfer roller 88 and a recovery roller 89. The rollers are fabricated in the form of frustums with a taper of relative dimensions such that when pressed against the discs and put in motion, the disc surface speed is the same as the roller surface speed at all points along the roller surface. Only one set of rollers are shown on the discs, but it is possible to mount a multiplicity of them along the disc surface. The slurry 59 to be separated is introduced into the water bath 63 and falls onto the top surface of the top disc 85 which is immersed below the water surface 42. Part of the oil phase is attracted to the oleophilic surface of the disc 85 and the remainder of the oil phase and the water phase of the slurry pass through the apertures 87 of the disc 85. Bitumen is transferred by the transfer roller 88 to the surface of the recovery roller 89 where a doctor blade (not shown) removes it for subsequent refining. The slurry is then guided by the baffle 90 and falls on top of the surface of the second disc 86 where substantially all of the remaining oil phase is recovered by the oleophilic surface of the disc, while the oil stripped sand particles pass through the apertures 87 and accumulate at the bottom of the water bath (not shown) for subsequent removal. Bitumen is removed from the second disc in the same manner as from the first using a transfer and collector roller as shown.

Thus the separator removes bitumen from a slurry of oil sand and water by contacting it with an apertured surface to which the bitumen adheres, while the remainder of the slurry passes through the apertures. In accordance with a broader view of the invention, a slurry or mixture consisting of bitumen or oil phase, water and particulate solids, initially before dilution by the bath water, is made to pass through the apertures of an oleophilic conveyor belt (or disc) that is submerged in a water bath. The belt (or disc) is preferaby horizontal but may be inclined if desired without departing from the scope of the invention. As the slurry or mixture passes through the apertures the bitumen or oil phase is attracted to the oleophilic surface and is recovered. Particulate solids in the water are removed from the bottom of the water bath. In some cases one belt flight (or one disc) is sufficient to achieve the separation, in others the slurry needs to pass through two or more belt flights (or discs) before the desired amount of oil phase is recovered.

The following examples are by way of illustration only and are not intended to limit the invention in any way. The separation conditions have already been described in detail for this process. It is to be understood, however, that various types of oil phases present in various types of mixtures can be recovered in the same manner as bitumen is recovered from the oil sand slurry, except for some changes in the process operation variables. One such variable would be the desired temperature of the slurry or mixture to be separated. This temperature is to be chosen for each system to provide optimum conditions for the oil phase to adhere to the surface of the apertured surface. Another variable is the density of the oil phase adhering to the apertured surface with respect to the density of the water in the water bath of the separator. When the oil phase is denser than the water, the mixture can be introduced into the water bath above the top belt flight and it can be made to pass through both belt flights before the water phase and/or solids in the water phase are removed from the bath. When the oil phase is lighter than the water, or when its density is very close to that of the bath water, then the mixture could be introduced between the top and bottom flights. The oil phase can then rise and/or sink and be recovered from both belt flights, while the water phase of the mixture and the solids in this water phase pass through the bottom belt flight only and are then removed from the bath. When a disc separator is used, the slurry or mixture could be introduced into the water bath between the two discs when the oil phase is lighter or close to the density of the bath water.

The practice of the invention is exemplfied by the following examples involving the equipment illustrated in FIGS. 1 and 4.

EXAMPLE 1

A steel conditioning drum is provided having a length of 24 inches and a diameter of 18 inches. The rear end of the drum contains a hopper for accepting oil sand and water. A screen is mounted on the front of the drum having a length of 12 inches and a diameter of 12 inches made from woven steel wire mesh with 0.12 inch square apertures. The drum is mounted on casters while a belt on the drum circumference attached to a motor driven pulley rotates the drum at 1 rpm. An average of 1060 pounds per hour of oil sand, analyzing 14.7 percent bitumen, 1.9 percent water, 76.7 percent particulate solids and 6.7 percent rocks and pebbles are fed to the conditioning drum for a period of three hours and are mixed therein with 250 pounds per hour of 50° F. water and 52 pounds of 5 psi steam per hour. The slurry passing through the screen at the front of the drum analyzes 12.0 percent bitumen, 24.7 percent water and 63.3 percent solids, has a temperature of 140° F., and pH of 7.0 Sixty pounds per hour of reject oversize material is removed from the front of the screen.

The product slurry is conveyed into four slurry hoppers shown in FIG. 4 as 43, 44, 45 and 46 that distribute the slurry as a ribbon onto the top flight of a 10 foot long 25 inch wide conveyor consisting of an apertured endless conveyor belt stretched between two 16 inch diameter endrolls. The belt is fabricated from woven nylon and coated with vulcanized neoprene. The apertures are rectangular having a size of about 0.15 by 0.25 inches with the larger dimension in the direction of belt movement. The conveyor is positioned in a bath tank having a capacity of 500 gallons.

The bath tank is supplied with 130° F. water such that the top flight of the belt is immersed for 10 inches below the water level. The exit of each slurry hopper is 2 inches below the level of the water in the bath. Sand and other mineral matter are removed at a rate of 805 pounds per hour from the bottom of the bath tank with an auger.

Eight sets of driven neoprene rollers shown schematically in FIG. 9, mounted along the top and bottom flights as illustrated in FIG. 4 by 47, 48, 49, 50, 53, 54, 55 and 56 provide the motive power to the belt. Each pair consists of a transfer roller mounted adjacent to the top surface of the belt and a recovery roller mounted adjacent to the bottom surface of the belt at each bitumen recovery location along the belt.

The top flight of the conveyor belt moves from right to left and the bottom flight moves from left to right. A doctor blade and cover, as illustrated in FIG. 11, are provided on each of the recovery rollers, adjacent to the top flight, to the left of the hopper, and a similar doctor blade and cover are also provided on each of the recovery rollers adjacent to the bottom flight, to the right of the slurry hopper. The transfer rollers each are offset from the collector rollers by a small distance so that they can effectively push bitumen, collected on the belt surface through the apertures onto the surfaces of the recovery rollers and aid the recovery rollers in cleaning bitumen out of the apertures. The bitumen is scraped from each recovery roller by doctor blades mounted adjacent thereto and flows under pressure into bitumen product chambers attached to the doctor blades. Diaphragm pumps are used to transfer the bitumen from these chambers to storage where 154 pounds of bitumen accumulate per hour.

The temperature of the slurry within the water bath stabilizes at about 130° F. Following are the results of the run:

Bitumen product:
- 9.0% solids
- 14.2% water
- 75.8% bitumen

Sand tailings product:
- 77.8% solids
- 22.0% water
- 0.2% bitumen

Bitumen recovery at equilibrium conditions:
- Over 90%

EXAMPLE 2

The same equipment and procedure as in Example 1 are used in Example 2 except for the following: An average of 870 pounds per hour of oil sand, analyzing 6.2% bitumen, 2.9% water, 82.9% particulate mineral and 8.0% rocks and pebbles are fed to the conditioning drum for a period of three hours and are mixed therein continuously with 250 pounds of 50° F. water per hour and 45 pounds of 5 psi steam per hour. The temperature of the slurry within the separation drum stabilizes at about 133° F.

The following are the results of the run:

Bitumen product:
- 18.3% solids
- 19.7% water
- 62.0% bitumen

Sand tailings product:
- 77.3% solids
- 21.4% water
- 1.3% bitumen

The above is illustrative of the invention and is not intended to be a limitation thereof. The invention is limited only by the appended claims.

I claim:

1. A method for recovering oil from a slurry containing oil, particulate solids and water which comprises the steps of:

(a) forming an aqueous slurry of water, oil and particulate solids, (b) introducing said slurry into a water bath containing an submerged, moving apertured wall having oleophilic surfaces, (c) bringing said slurry into contact with said submerged moving apertured wall at a temperature such that the oil has a viscosity in the range of 0.1 to 10,000 poises wherein the oil is attracted to the oleophilic surfaces and adheres thereto and the particulate solids pass through the apertures of said wall; and, (d) recovering the adhering oil from the submerged, moving apertured wall while submerged.

2. The method as set forth in claim 1 wherein the apertures of said wall have dimensions within the range of 0.05 to 0.5 inches.

3. The method as set forth in claim 2 wherein the temperature of the mixture undergoing separation in the water bath is within the range of 32° F. to 212° F.

4. The method as set forth in claim 3 wherein the viscosity of the oil phase of the slurry undergoing separation in the water bath is within the range of 10 to 1000 poises.

5. The method as set forth in claim 3 comprising:

(a) transferring said oil phase adhering to the apertured surface and through the apertures; and (b) recovering said oil phase for further treatment.

6. The method as set forth in claim 5 comprising:

(a) forcing said oil phase, adhering to the surface of the apertured wall, with a transfer roller, into and through the apertures;

(b) removing said oil phase from the apertured wall and out of the apertures onto the surface of a recovery roller; and (c) removing the oil phase from the surface of the recovery roller by recovery means for further treatment;

(d) wherein there is a small positive distance of offset in the direction of apertured wall movement between the transfer roller and the recovery roller, such that transfer of oil through and out of the apertures and onto the recovery roller surface is enhanced.

7. The method as set forth in claim 6 wherein the recovery roller has an oleophilic surface.

8. The method as set forth in claim 7 wherein the recovery roller is partially surrounded by a cover forward of the recovery means extending from one end of the roller to the other and set at a predetermined distance from the surface of said roller so as to create a cavity between the roller surface and said cover such that, as the roller rotates and oil is removed from said roller surface by the recovery means, the removed oil from the roller fills and becomes trapped in said cavity where continued rotation of the roller creates a shear in the trapped oil which causes pressure therein and also causes said trapped oil to flow in a lateral direction to removal means.

9. The method according to claim 8 wherein the cover and recovery means are interconnected to form a chamber into which the oil flows until the chamber and cavity are filled with trapped oil whereupon continued rotation of said roller creates a shear in the trapped oil which causes pressure therein and also causes said trapped oil to flow from said chamber in a lateral direction to removal means.

10. The method according to claim 9 wherein the recovery means is a doctor blade.

11. The method as set forth in claim 7 wherein the transfer roller also has an oleophilic surface.

12. The method as set forth in claim 11 wherein oil to be recovered from the belt is forced back and forth through the belt apertures by oleophilic transfer rollers one or more times prior to its recovery.

13. The method as set forth in claim 7 wherein the apertures in the contacting wall have dimensions within the range of 0.10 to 0.30 inches.

14. The method as set forth in claim 7 wherein the apertured wall is in the form of an endless belt.

15. The method as set forth in claim 14 wherein the slurry is introduced into the water bath at multiple sites and oil is recovered from the endless belt at multiple sites.

16. The method as set forth in claim 15 wherein the apertured wall is in the form of an endless mesh belt.

17. The method as set forth in claim 15 wherein the apertured wall is in the form of an endless perforated belt.

18. The method as set forth in claim 7 wherein the apertured wall is in the form of a disc.

19. The method according to claim 7 wherein slurry particles too large to pass through the apertures of the apertured wall are removed from the slurry prior to bringing the slurry into contact with the apertured wall.

20. A method for recovering bitumen from oil sands which comprises the steps of:

(a) mixing oil sand with water and steam in a rotating conditioning drum to form a slurry, (b) introducing the slurry into a water bath containing an submerged, moving apertured endless belt separator having one or more oleophilic surfaces;

(c) bringing the slurry into contact with the submerged moving with the apertured belt at a temperature such that the bitumen has a viscosity in the range of 0.1 to 10,000 poises wherein bitumen depleted oil sand slurry passes through the apertures and bitumen contacts an oleophilic surface of said apertured belt and adheres thereto; and (e) recovering the adhering bitumen from said submerged apertured belt surface while submerged.

21. The method as set forth in claim 20 wherein the apertures of said belt have dimensions within the range of 0.05 to 0.50 inches.

22. The method as set forth in claim 21 wherein the temperature of the slurry undergoing separation in the water bath is within the range of 85° F. to 212° F.

23. The method as set forth in claim 22 wherein the viscosity of the oil phase of the slurry undergoing separation in the water bath is within the range of 10 to 1000 poises.

24. The method as set forth in claim 22 comprising:

(a) transferring bitumen adhering to the apertured belt surface into and through the apertures; and (b) recovering the bitumen for further treatment.

25. The method as set forth in claim 24 comprising:

(a) forcing bitumen, adhering to the apertured belt, with a transfer roller, into and through the apertures;

(b) removing bitumen from the belt surface and out of the apertures onto the surface of a recovery roller; and (c) removing the bitumen from the recovery roller by recovery means for further treatment;

(d) wherein there is a small positive distance of offset in the direction of belt movement between the transfer roller and the recovery roll, such that transfer of bitumen between and out of the apertures and onto the recovery roller surface is enhanced.

26. The method as set forth in claim 25 wherein the slurry is introduced into the water bath at multiple sites and bitumen is recovered from the endless belt at multiple sites.

27. The method as set forth in claim 26 wherein the endless apertured belt contains a plurality of transfer rollers and recovery rollers working in combination to remove bitumen for further treatment.

28. The method as set forth in claim 27 wherein the recovery rollers have oleophilic surfaces.

29. The method as set forth in claim 28 wherein the recovery roller is partially surrounded by a cover forward of the recovery means extending from one end of the roller to the other and set at a predetermined distance from the surface of said roller so as to create a cavity between the roller surface and said cover such that, as the roller rotates and oil is removed from said roller surface by the recovery means, the removed oil from the roller fills and becomes trapped in said cavity where continued rotation of the roller creates a shear in the trapped oil which causes pressure therein and also causes said trapped oil to flow in a lateral direction to removal means.

30. The method according to claim 29 wherein the cover and recovery means are interconnected to form a chamber into which the oil flows until the chamber and cavity are filled with trapped oil whereupon continued rotation of said roller creates a shear in the trapped oil which causes pressure therein and also causes said trapped oil to flow from said chamber in a lateral direction to removal means.

31. The method according to claim 30 wherein the recovery means is a doctor blade.

32. The method as set forth in claim 28 wherein the transfer rollers also have oleophilic surfaces.

33. The method as set forth in claim 28 wherein said belt is a mesh belt.

34. The method as set forth in claim 28 wherein said belt is a perforated belt.

35. The method as set forth in claim 27 wherein the slurry first contacts a top flight of the apertured endless belt and part of the bitumen adheres to the oleophilic belt surface with the remainder of the slurry passing through the apertures in the top flight onto a bottom flight of the oleophilic belt wherein additional bitumen adheres to the oleophilic surface of said bottom flight with the oil depleted slurry passing through apertures in the bottom flight.

36. The method as set forth in claim 32 wherein oil to be recovered from the belt is forced back and forth through the belt apertures by oleophilic transfer rollers one or more times prior to its recovery.

37. The method as set forth in claim 35 wherein bitumen is also recovered from the surface of the transfer rollers.

38. The method as set forth in claim 25 wherein the apertures in the belt have breadth and width dimensions within the range of 0.1 to 0.3 inches.

39. The method as set forth in claim 25 wherein the temperature of the slurry undergoing separation in the water bath is within the range of 85°–140° F.

40. The method as set forth in claim 25 wherein the temperature of the slurry undergoing separation in the water bath is within the range of 141°–212° F.

41. The method as set forth in claim 20 wherein monoalkaline reagents are added to the slurry in said conditioning drum.

42. The method as set forth in claim 20 wherein the slurry formed in the conditioning drum is treated in a sand reduction apparatus prior to transferring it to the submerged, moving apertured, endless belt separator, such that, solid particles larger than the separator apertures, and coarse sand, are removed from, and water is added to the slurry before it contacts the oleophilic separator surface while submerged.

* * * * *